US006609496B1

(12) United States Patent
Bruch et al.

(10) Patent No.: US 6,609,496 B1
(45) Date of Patent: Aug. 26, 2003

(54) ENGINE CONTROLLER FOR AN INTERNAL COMBUSTION ENGINE

(75) Inventors: Kevin L. Bruch, West Lafayette, IL (US); Robert J. Maxson, Lafayette, IL (US); Geoffrey D. Ginzel, Lafayette, IL (US)

(73) Assignee: Caterpillar Inc, Peoria, IL (US)

( * ) Notice: Subject to any disclaimer, the term of this patent is extended or adjusted under 35 U.S.C. 154(b) by 242 days.

(21) Appl. No.: 09/728,648

(22) Filed: Dec. 1, 2000

(51) Int. Cl.[7] ..... F02M 3/00
(52) U.S. Cl. ..... 123/339.12; 123/672
(58) Field of Search ..... 123/339.12, 680, 123/494, 480, 687, 689, 693, 700, 701, 672

(56) References Cited

U.S. PATENT DOCUMENTS 4,430,978 A 2/1984 Lewis et al.
4,537,172 A 8/1985 Kanehara et al.
4,617,904 A 10/1986 Pagdin
4,867,127 A 9/1989 Quirchmayr et al.
5,934,248 A * 8/1999 Toyoda ..... 123/339.12
6,178,371 B1 * 1/2001 Light et al. ..... 123/339.12
6,226,981 B1 5/2001 Bruch et al. ..... 60/274
6,367,446 B1 * 4/2002 Kanamaru et al. ..... 123/339.12

* cited by examiner

*Primary Examiner*—John Kwon
(74) *Attorney, Agent, or Firm*—Marshall, Gerstein & Borun

(57) ABSTRACT

An engine controller regulates fuel flow to an internal combustion engine based on sensed air flow and sensed engine operational parameters. The engine controller includes a speed sensor, a power sensor, an airflow meter and a controller unit. The speed sensor generates an engine speed signal representative of sensed engine speed, the power sensor generates an output power signal representative of sensed engine output power and the airflow meter generates an actual airflow signal representative of sensed airflow. The controller unit is responsive to the engine speed signal, the output power signal and the actual airflow signal and develops a command signal for an air-fuel mixer.

20 Claims, 3 Drawing Sheets

ENGINE CONTROLLER FOR AN INTERNAL COMBUSTION ENGINE

TECHNICAL FIELD

The present invention relates generally to engine controllers and, more particularly, to an engine controller for an internal combustion engine which regulates fuel flow to the engine based on engine operational parameters and airflow to the engine.

BACKGROUND ART

Internal combustion engines typically include an air-fuel controller that regulates the proportions of air and fuel supplied to one or more combustion chambers of an engine to permit efficient operation thereof while ensuring reduced emissions of undesirable pollutants, such as $NO_x$. One prior art air-fuel controller employs an oxygen probe to measure the content of oxygen present in the-exhaust gas generated by the engine. If the oxygen probe detects high amounts of oxygen in the exhaust, the air-fuel mixture is determined to be too lean and the air-fuel controller increases the proportion of fuel to air in the mixture supplied to the combustion chambers. If the oxygen probe detects low amounts of oxygen in the exhaust, the air-fuel mixture is determined to be too rich and the air-fuel controller reduces the proportion of fuel to air. However, prolonged exposure to engine combustion products and heat often causes the oxygen probe to malfunction.

Quirchmayr et al. U.S. Pat. No. 4,867,127 discloses an air-fuel regulator which regulates an air-fuel mixture supplied through an induction line to an engine. The air-fuel regulator controls the pressure of the air-fuel mixture in the induction line in accordance with the sensed power output of the engine, the sensed mixture pressure and the sensed mixture temperature so that the actual value of the air to fuel ratio follows a desired value curve thereby achieving a reduction in undesirable $NO_x$ emissions. The air-fuel mixture pressure is controlled by manipulating a positioning valve disposed in an air bypass line which is coupled across the air-fuel mixer.

The present invention is directed to overcoming one or more of the problems or disadvantages associated with the prior art.

DISCLOSURE OF THE INVENTION

In accordance with one aspect of the present invention an engine controller for controlling fuel flow supplied to an internal combustion engine by a fuel valve coupled to an air-fuel mixer having an air intake includes a speed sensor and a power sensor. An airflow meter is operatively coupled to the air intake of the air-fuel mixer and a controller unit includes inputs coupled to the speed sensor, the power sensor and the airflow meter and an output coupled to the fuel valve.

In accordance with another aspect of the present invention, a method for controlling fuel flow supplied to an internal combustion engine by an air-fuel mixer includes the steps of sensing an inlet manifold temperature, sensing engine speed, sensing engine output power and sensing airflow supplied to an air-fuel mixer. The method further includes the step of determining desired fuel flow to the air-fuel mixer based on the sensed inlet manifold temperature, the sensed engine speed, the sensed engine output power and the sensed air flow and the step of issuing a drive signal and adjusting fuel flow supplied to the air-fuel mixer to equal substantially a desired fuel flow.

In accordance with yet another aspect of the present invention, an engine having an engine controller for controlling fuel flow supplied to the engine includes an air-fuel mixer coupled to an air source and a fuel source, an inlet manifold in fluid communication with the air-fluid mixer and a combustion chamber in fluid communication with the inlet manifold. A controller unit is responsive to a signal representative of an engine speed, a signal representative of an output power generated by the engine and a signal representative of an actual airflow to the air-fuel mixer, wherein said controller unit develops a drive signal and regulates fuel flow to the air-fuel mixer.

BEST MODE FOR CARRYING OUT THE INVENTION

Figure 1:
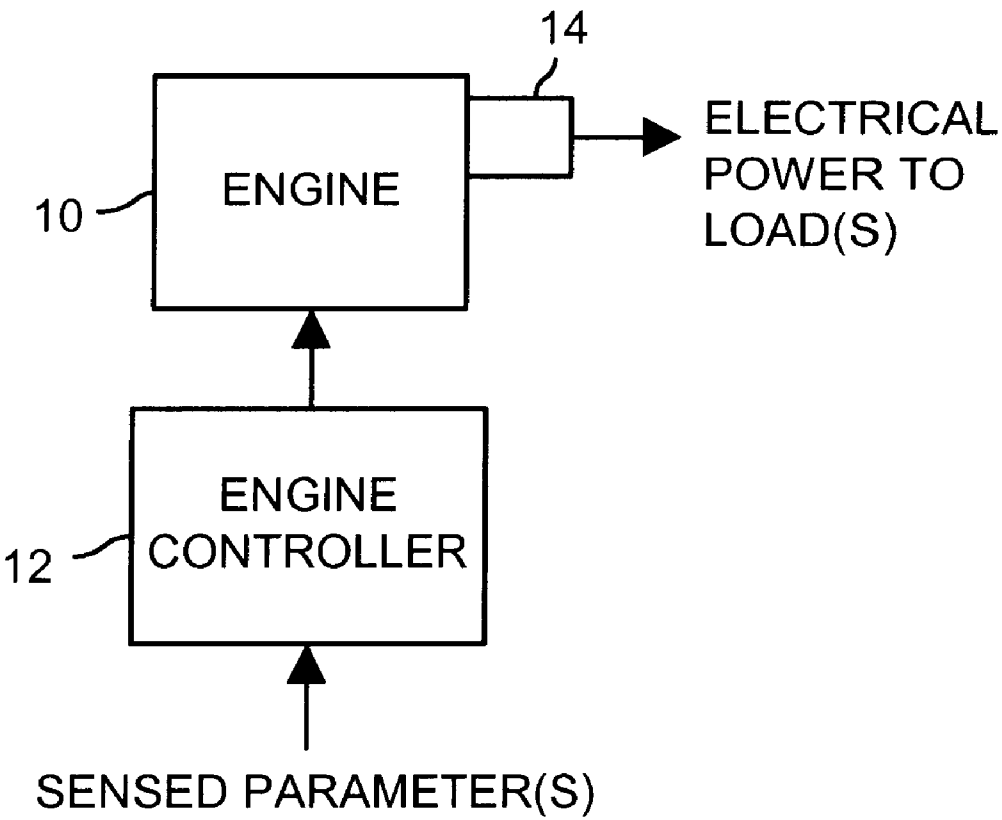
FIG. 1 is a block diagram of an internal combustion engine in combination with an engine controller according to an embodiment of the present invention.

Referring now to FIG. 1, an internal combustion engine 10 is responsive to commands issued by an engine controller 12 connected to the engine 10. The engine controller 12 receives inputs representing one or more sensed parameters. In the illustrated embodiment, the internal combustion engine 10 is operatively connected by an engine shaft (not shown) to an electrical generator 14 which is, in turn, coupled to one or more loads (not shown). Preferably, although not necessarily, the electrical generator 14 is of the synchronous type and the engine 10 runs at a substantially constant speed. Thus, the electrical generator 14 develops electrical power at a desired constant frequency. If desired, the present invention may instead be used with an internal combustion engine 10 which runs at selectable speed commanded by an operator and/or which may provide motive power to one or more loads other than an electrical generator 14.

Figure 2:
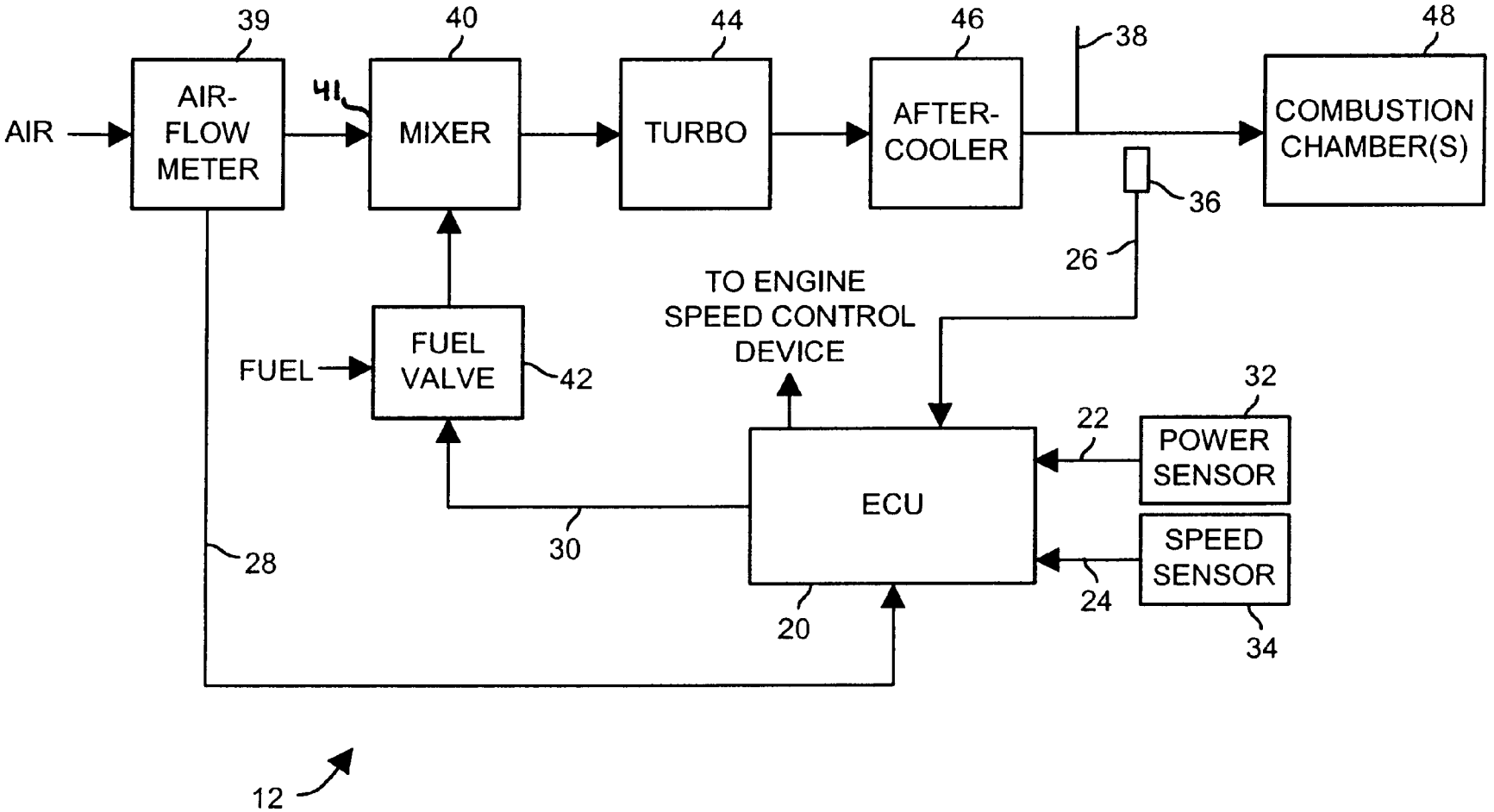
FIG. 2 is a block diagram illustrating the engine controller of FIG. 1 in greater detail together with selected engine components.

As seen in FIG. 2, the engine controller 12 includes a controller unit 20 having inputs which receive signals provided over a plurality of lines 22, 24, 26, 28. The controller unit 20 further includes an output at which a drive signal is provided to a controllable fuel valve 42 over a line 30. The power signal on the line 22 is developed by a power sensor 32 which senses the power developed by the internal combustion engine 10. The power sensor 32 may, for example, include voltage and current detectors and a multiplier. Alternatively, the power sensor 32 may include different components. For example, in the case where the engine speed is constant, the torque developed by the internal combustion engine 10 is directly proportional to the engine power. Thus, a torque detector (such as a strain gauge or an accelerometer) could be used to detect engine torque, and the signal developed thereby may be supplied over the line 22 as the power signal. Where the engine speed is not constant, the power sensor 32 may utilize signals representing the torque developed by the internal combustion engine 10 and the engine speed to obtain an indication of engine power.

The speed signal on the line 24 is developed by a speed sensor 34, which senses rotation of a shaft driven by the internal combustion engine 10. The speed sensor 34 may include any suitable component, such as, for example, a magnetic pick-up (MPU), hall-effect sensor or the like. Alternatively, the speed sensor 34 may be responsive to the above-noted voltage or current detectors and may further include circuitry that converts the alternating waveform(s) developed by the electrical generator 14 (FIG. 1) into an indication of engine speed.

The controller unit 20 is further responsive to a temperature signal on the line 26 developed by a temperature sensor 36 wherein the temperature signal represents the temperature of an air-fuel mixture in an inlet manifold 38 of the internal combustion engine 10. The controller unit 20 is further responsive to an airflow signal on the line 28 developed by an airflow meter 39. The airflow meter 39 may be of any suitable type, such as a hot-wire anemometer, a butterfly type airflow meter, a turbine style airflow meter, or the like. The airflow meter 39 detects the magnitude of the mass of the airflow into an air-fuel mixer 40 via an air intake 41. The air-fuel mixer 40 receives fuel metered by the controllable fuel valve 42, wherein the latter is controlled by the controller unit 20 via the line 30 in response to the signals on the lines 22, 24, 26 and 28.

The air-fuel mixture is provided by the air-fuel mixer 40 to a turbocharger 44 and an aftercooler 46. Thereafter, the pressure-boosted and cooled air-fuel mixture is provided through the inlet manifold 38 to one or more combustion chamber(s) 48 of the internal combustion engine 10.

Alternatively, the air fuel mixture may be located between the turbocharger 44 and the combustion chamber 48. In this embodiment, high pressure fuel and compressed air from the turbocharger will be mixed and delivered to one or more combustion chambers 48. In some applications the air flow meter 39 may be located down stream of the turbocharger 44 between the manifold 38 and the turbocharger 44.

Figure 3:
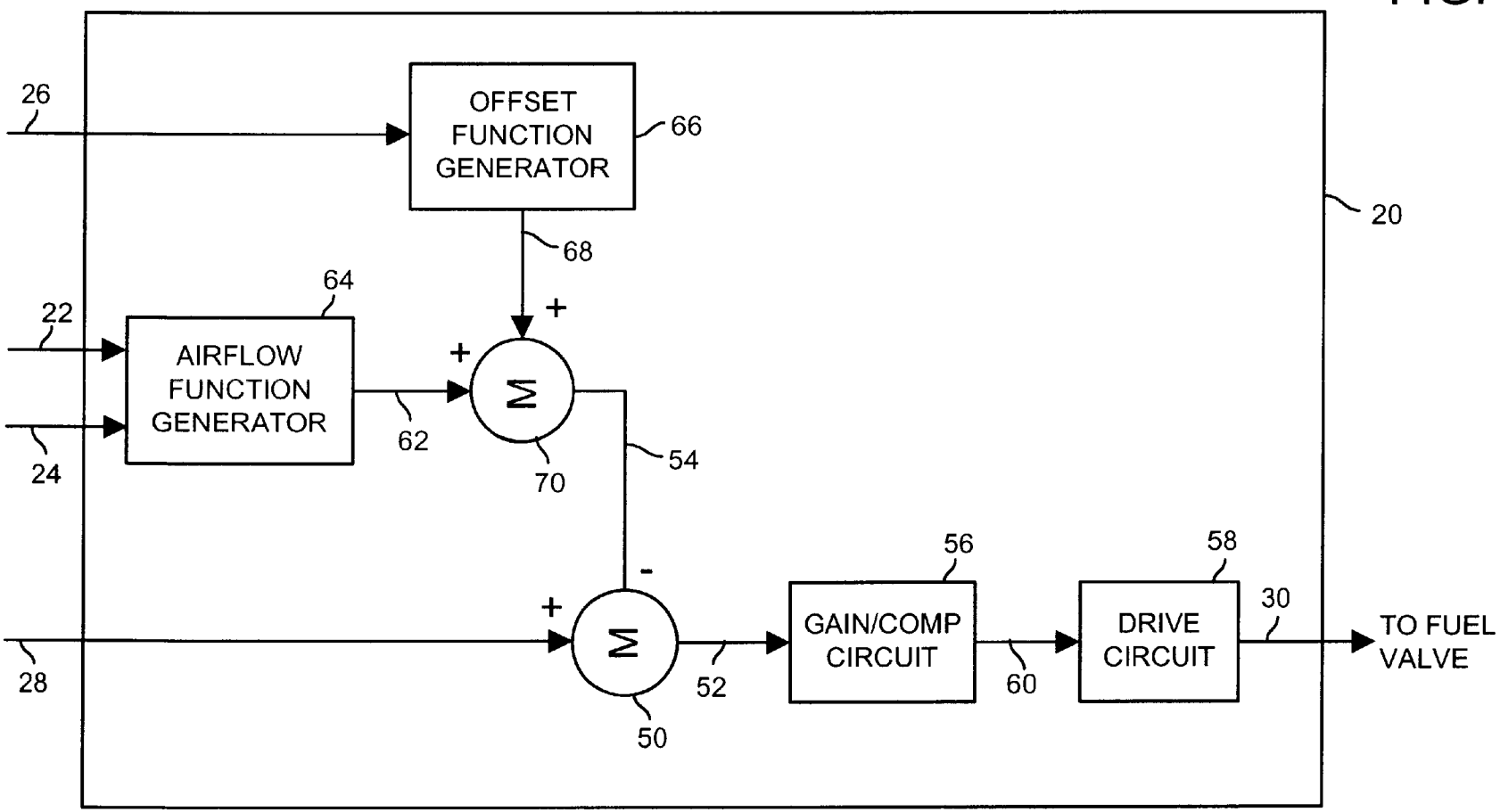
FIG. 3 is a block diagram illustrating the controller unit of FIG. 2 in greater detail.

Referring now to FIG. 3, the controller unit 20 includes a difference amplifier 50 which develops an error signal on a line 52 as a function of the difference between the actual airflow signal on a line 28 and a desired airflow signal on a line 54. The desired airflow signal is representative of desired airflow to the internal combustion engine 10. A gain/compensation circuit 56 accepts the error signal as an input and delivers a command signal to a drive circuit 58 over a line 60. In response to the command signal, the drive circuit 58 develops the drive signal on the line 30 to adjust the fuel valve 42 to correct the amount of fuel supplied to the air-fuel mixer 40.

The desired airflow signal on a line 62 is developed by an airflow function generator 64 which is responsive to the power signal and the speed signal on the lines 22, 24, respectively. The airflow function generator 64 may include a look-up table where values for engine output power and the engine speed for a specific type of engine are mapped to specific desired airflow values. The production of $NO_x$ is also a function of the temperature of the air-fuel combustion mixture. An offset based on the inlet manifold temperature may be used to further refine the value of the desired airflow. An offset function generator 66 is responsive to the temperature signal on the line 26 and includes an output that provides an offset signal on a line 68. The offset function generator 66 may include a look-up table where values for inlet manifold temperatures are mapped to specific offset values for particular engines.

A summer 70 is responsive to the offset signal and the desired airflow signal on the line 62 such that the desired airflow signal generated on the line 54 is representative of a refined desired airflow. This refined desired airflow is supplied to the difference amplifier 50 as an input on the line 54.

The controller unit 20 may be implemented using hardware, software, firmware or any combinations thereof or any other technologies which facilitate the performance of the controller unit 20 operations.

INDUSTRIAL APPLICABILITY

Referring to FIGS. 1–3, the engine controller 20 initially determines desired airflow to the air-fuel mixer 40. The power sensor 32 senses power developed by the internal combustion engine 10 and generates the representative power signal on the line 22. Specifically, in the event that the power sensor 32 includes the voltage and current detectors and the multiplier noted above, the voltage and current detectors sense the magnitudes of the voltage(s) and current (s) developed by the electrical generator 14. The multiplier multiplies the outputs of the voltage and current detectors to obtain the power signal. Preferably, although not necessarily, a three-phase electrical generator is used to drive a balanced load thereby permitting the measurement of the magnitude of the voltage and the current on any one of the three phases. However, if the three-phase electrical generator is used to power an unbalanced load, the magnitudes of the voltages and the currents must be measured for each of the phases. It should be noted that the internal combustion engine 10 of the present invention may alternatively provide motive power to a generator having a different number of phases, such as a single-phase generator.

The speed signal on the line 24 is developed by the speed sensor 34, which senses the rotation of the engine shaft of the internal combustion engine 10. The airflow function generator 64 is responsive to the power signal and the speed signal and develops a desired airflow signal on the line 62 which is representative of desired airflow to the air-fuel mixer 40.

The temperature sensor 36 senses the temperature of the air-fuel mixture in the inlet manifold 38 and develops the temperature signal representative of the sensed temperature on the line 26. The offset function generator 66 is responsive to the temperature signal and develops an offset signal on the line 68 representative of an offset value for refining the desired airflow as developed by the airflow function generator 64. The summer 70 is responsive to the desired airflow signal on the line 62 and the offset signal on the line 68 and develops a refined desired airflow signal on the line 54.

The engine controller 20 develops an error signal based on the difference between actual airflow and desired airflow. Specifically, the airflow meter 39 senses the airflow to the air-fuel mixer 40 and develops the actual airflow signal on the line 28 representative of the sensed airflow. The difference amplifier 50 accepts the desired airflow signal on the line 54 and the actual airflow signal on the line 28 as inputs and develops the error signal on the line 52.

The gain/compensation circuit 56 is responsive to the error signal on the line 52 and develops the command signal on the line 30 to correct the amount of fuel supplied to the air-fuel mixer 40. The drive circuit 58 is responsive to the air-fuel command signal and develops a drive signal on line 60 to adjust the fuel valve 42 thereby controlling the flow of fuel to the air-fuel mixer 40. The air-fuel mixture is supplied by the air-fuel mixer 40 to the turbocharger 44 and the aftercooler 46. The pressure boosted and cooled air-fuel mixture is provided through the inlet manifold 38 to the combustion chamber(s) 48. The combustion of the air-fuel mixture in the combustion chamber(s) 48 provides motive power to the electrical generator 14 which in turn develops electrical power for one or more loads. The corrected fuel flow supplied to the air-fuel mixer 40 by the engine controller 12, maintains the desired engine output parameters while simultaneously controlling the amount of $NO_x$ produced.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

Other aspects and features of the present invention can be obtained from a study of the drawings, the disclosure, and the appended claims.

What is claimed is:

1. An engine controller for controlling fuel flow supplied to an internal combustion engine by a fuel valve coupled to an air-fuel mixer having an air intake, comprising:

a speed sensor operatively coupled to the engine;

a power sensor operatively coupled to the engine;

an airflow meter operatively coupled to the air intake of the air-fuel mixer; and a controller unit having inputs coupled to the speed sensor, the power sensor and the airflow meter and an output coupled to the fuel valve.

2. The engine controller of claim 1, wherein said controller unit includes a difference amplifier which develops an error signal as an output in response to the actual airflow signal and a signal representing desired airflow.

3. The engine controller of claim 2, wherein the controller unit includes a gain/compensation circuit, which generates a command signal in response to the error signal.

4. The engine controller of claim 2, wherein the controller unit includes an airflow function generator which generates a signal representing desired airflow in response to a speed signal and a power signal.

5. The engine controller of claim 2, wherein the controller unit includes a summer having a first input which receives a signal representing desired airflow and a second input which receives an offset signal and an output coupled to the difference amplifier.

6. The engine controller of claim 5, wherein the controller unit includes an offset function generator which generates the offset signal in response to a temperature signal representative of inlet manifold temperature.

7. The engine controller of claim 6, including a temperature sensor being adapted to generate the temperature signal representative of inlet manifold temperature.

8. The engine controller of claim 1, wherein the airflow meter is a hot-wire anemometer.

9. A method for controlling fuel flow supplied to an internal combustion engine by an air-fuel mixer, the method comprising the steps of:

sensing an inlet manifold temperature;

sensing an engine speed;

sensing an engine output power;

sensing an airflow supplied to an air-fuel mixer;

determining desired fuel flow to the air-fuel mixer based on the sensed inlet manifold temperatures the sensed engine speed, the sensed engine output power and the sensed air flow; and issuing a drive signal to cause a fuel flow supplied to the air-fuel mixer to equal substantially a desired fuel flow.

10. The method of claim 9, including the step of developing an error signal based on a difference between the sensed airflow and a desired airflow.

11. The method of claim 10, including the step of developing the drive signal based on the error signal.

12. The method of claim 10, including the step of determining the desired airflow based on sensed engine speed and sensed engine output power.

13. The method of claim 10, including the step of refining the desired airflow based on an offset value.

14. The method of claim 13, including the step of deriving the offset value based on the sensed inlet manifold temperature.

15. An engine having an engine controller for controlling fuel flow supplied to the engine, comprising:

an air-fuel mixer coupled to an air source and a fuel source;

an inlet manifold in fluid communication with the air-fuel mixer;

a combustion chamber in fluid communication with the inlet manifold; and a controller unit responsive to a signal representative of an engine speed, a signal representative of an output power generated by the engine and a signal representative of an actual airflow to the air-fuel mixer, said controller unit developing a drive signal to regulate fuel flow to the air-fuel mixer.

16. The engine of claim 15, wherein the controller unit includes a difference amplifier being responsive to a signal representative of a desired airflow and the signal representative of the actual airflow and which develops an error signal.

17. The engine of claim 16, wherein the controller unit includes a gain/compensation circuit that generates a command signal responsive to the error signal.

18. The engine of claim 16, wherein the controller unit includes an airflow function generator that develops the signal representative of desired airflow responsive to the signal representative of engine speed and the signal representative of power generated by the engine.

19. The engine of claim 16, wherein the controller unit includes a summer having a first input which receives the signal representative of the desired airflow and a second input which receives an offset signal and an output coupled to the difference amplifier.

20. The engine of claim 19, wherein the controller unit includes an offset function generator being adapted to generate the offset signal responsive to a signal representative of inlet manifold temperature.

* * * * *